United States Patent [19]

Miyamoto et al.

[11] Patent Number: 4,917,034

[45] Date of Patent: Apr. 17, 1990

[54] CARRYING BARGE

[75] Inventors: Masahiko Miyamoto, Fukuoka; Shinji Tanaka; Masami Mitsuse, both of Osaka; Kohei Murata, Toyonaka; Yoshihiro Masui, Kobe, all of Japan

[73] Assignee: Osakawan Marine Corporation, Osaka, Japan

[21] Appl. No.: 254,692

[22] Filed: Oct. 7, 1988

[51] Int. Cl.[4] ..... B63B 35/30

[52] U.S. Cl. ..... 114/29; 49/477; 49/484; 114/201 A

[58] Field of Search ..... 114/27–30, 114/36, 201 A, 353; 414/137.7; 49/477, 484, 488

[56] References Cited

U.S. PATENT DOCUMENTS

| | | | |
|---|---|---|---|
| 3,509,841 | 5/1970 | Boer | 114/29 |
| 4,084,527 | 4/1978 | Hellmich | 114/36 |

FOREIGN PATENT DOCUMENTS

| | | | |
|---|---|---|---|
| 1278270 | 9/1968 | Fed. Rep. of Germany . | |
| 1292532 | 4/1969 | Fed. Rep. of Germany | 114/29 |
| 1902434 | 9/1970 | Fed. Rep. of Germany . | |
| 78893 | 4/1988 | Japan | 114/29 |
| 6609635 | 1/1968 | Netherlands . | |
| 7705713 | 11/1978 | Netherlands . | |
| 134991 | 2/1960 | U.S.S.R. | 114/29 |
| 639755 | 4/1979 | U.S.S.R. | 114/29 |

*Primary Examiner*—Sherman D. Basinger
*Attorney, Agent, or Firm*—Wenderoth, Lind & Ponack

[57] ABSTRACT

An improved two-split carrying barge according to the present invention is aimed at solving the problem of ensuring watertightness at the opening portion of a hold of the barge. The carrying barge of the present invention has left and right parts of a hull that are rotated through hinges to open or close the hold at the bottom of the barge. The left and right parts of the hull are positively coupled by a coupling device which can be released with great ease by remote control when loaded cargo is to be expelled from the hold of the barge. Moreover, the carrying barge of the present invention is equipped with a rubber packing arrangement at the opening portion between the left and right parts of the hull. Since the rubber packing arrangement can flexibly cope with a change in the width of the opening portion due to rolling or pitching, the watertightness of the carrying barge of the present invention is ensured.

5 Claims, 10 Drawing Sheets

CARRYING BARGE

BACKGROUND OF THE INVENTION

The present invention generally relates to a carrying barge for carrying loads such as soil and sand, buiding stones, etc. to be expelled from a hold of the barge at a predetermined place in the sea, and more particularly, to an improvement in the watertightness of a two-split type carrying barge in which right and left hulls are arranged to be rotated to open the bottom of a hold at the center line when the load is to be expelled.

Conventionally, cargo, soil and sand or the like have been loaded and carried by a steel lighter or a steel barge of the type shown in FIG. 17, the bottom of a hold A of which is not opened, or a carrying boat as shown in FIG. 18(A) having a door B formed in the lower right and left sides of the hold A, or a two-split type carrying boat as shown in FIG. 19 which has a main hull divided into right and left portions which are arranged to be rotated to open the hold.

Although the carrying boat shown in FIG. 17 is free from the undesired possibility of the load getting wet, it has such a drawback in that the load, if it comprises particle or powdery goods, is difficult to be completely expelled. The carrying boat of FIG. 18 is convenient when particle or powdery goods are expelled. However, the watertightness cannot be secured in the carrying boat of FIG. 18 and, therefore, the kind of cargo to be loaded in the carrying boat of FIG. 18 is limited. Furthermore, if the goods get wet because of the poor watertightness of the carrying boat of FIG. 18, the total weight of the goods loaded is increased, resulting in an uneconomical requirement for a large hull of the carrying boat.

On the other hand, the two-split type carrying boat shown in FIG. 19 is comprised of left and right rotatable hull parts 1 and 2, fixed front and rear hull parts 3 and 4 which constitute a machine room, etc., and a hold 5 defined by the left and right hull parts 1 and 2. The left and right hull parts 1 and 2 are arranged to be rotated, as shown in FIG. 19, at the fulcrum of hinges 6 respectively provided at the bow side and the stern side of the boat, so that the bottom of the boat is opened to open the hold 5. The above-described two-split type is advantageous in that the loaded cargo can be conveniently expelled, and moreover, a large capacity of the hold can be obtained in comparison with the size of the hull. However, in the carrying boat having the above-described structure, since the watertightness at the opening portion between the right and left hull parts at the center line L of the bottom of the hold 5 is secured only by a rubber packing 7, and moreover, the two hinges 6 hold the hull parts over the long distance from the bow to the stern of the boat, the left and right hull parts 1 and 2 are apt to be affected by different curves or vibrations from each other during navigation or upon the application of shocks thereto. In such a case, the water tightness at the opening portion of the hold 5 can not be secured only by the above rubber packing 7, resulting in the passage of water into these hold. In the circumstances, therefore, the length of the hold has conveniently been more or less than 30 m, and the loading capacity is restricted to 2–3000 tons. Thus, the above-described two-split type has been employed in a relatively small carrying boat, but can not be utilized in a large carrying boat.

SUMMARY OF THE INVENTION

An essential object of the present invention is to provide a carrying barge having an improved two-split structure aimed at solving the problem of watertightness of a hold inherent in the prior art carrying boat, so that the structure is employable in a large barge, thereby facilitating the advantages possessed by the prior art carrying boat.

In accomplishing the above-described object, according to the present invention, the two-split type carrying barge which has upper parts of left and right hulls secured to fixed hulls through hinges is so arranged that, when the left and right hulls are rotated, the bottom of the barge is separated at the center line thereof to open the bottom of the hold. The carrying barge of the present invention is provided with coupling means between the opposite ends of the opening portion at the center line of the bottom of the hold. The coupling means are arranged to be unseparably coupled with each other by a hydraulic cylinder or the like, with some distance in the lengthwise direction therebetween. Therefore, when the cargo is loaded in the carrying barge, the coupling means are locked so as to positively prevent the separation of the ends of the opening portion thereby ensuring watertightness. On the other hand, when the cargo is to be expelled from the carrying barge, the coupling means are released to easily open the hold. It is convenient that the coupling means are operated with great ease via a remote control, for example, by switching the oil pressure.

A further object of the present invention is to provide an improved coupling means having a simplified structure for use in a carrying barge of the type referred to above, which is easily locked or released, while enabling positive coupling of the left and right hulls at the center line of the bottom of the barge.

In accomplishing the above-described further object, according to the present invention, a coupling means is provided at the opening portion of the right and left hulls, which opening portions forms the bottom of a hold of the carrying barge. The upper parts of the right and left hulls are secured to fixed hulls through hinges, so that the right and left hulls can be rotated to be separated at the bottom of the barge at the center line to open the bottom of the hold.

A T-shaped metal fitting is fixed to one end of the opening portion at the bottom of the right and left hulls, while a pair of clamp arms to be clamped with the above metal fitting are rotatably supported at the other end of the opening portion. The pair of clamp arms are rotated by respective hydraulic cylinders to clamp the metal fitting from the opposite sides thereof in engaging portions formed at one end of each clamp arm, and at the same time, a clamp cylinder, which is inserted in or removed from between the clamp arms by the oil pressure, is provided at the other end of the clamp arms to lock the clamp arms in a clamped position at a locking portion formed integrally with the clamp cylinder.

A still further object of the present invention is to provide a rubber packing arrangement of a carrying barge of the type referred to above which can flexibly cope with a change in the distance between the ends of the opening portion due to the rolling or pitching of the barge, while exhibiting a complete sealing effects to prevent the outflow and soaking of the load.

In accomplishing the above-described still further object, a rubber packing arrangement of the present invention employs a packing system which is provided with a plate-like rubber member at the upper part of the upper surface of the opening portion inclined at given angles with respect to the bottom of the barge, hollow rubber member formed below the above-described rubber member into which can be passed liquid or gas, and a tubular rubber member at the lowest part of the opening portion.

Acording to the packing arrangement of the aforementioned structure, the opening portion is closed and the bottom of the barge is locked when the cargo is to be loaded. At this time, the upper and lower rubber members are in contact with the opposite surface of the opening portion. Then, the water or the air is introduced into the hollow rubber material to urge such material into pressing contact with the opposite surface of the opening portion. Thereafter, the cargo is loaded. When the cargo is to be unloaded, the pressure in the hollow rubber member is relieved, and the opening portion is opened. In the above-described arrangement, since the surface of the opening portion is inclined by predetermined angles with respect to the bottom of the barge, sand or the like slides down along the inclined surface, thus reducing the shocks caused when the loads are expelled from the barge in comparison with the case where sand is thrown down in a direction extending vertically to the bottom or the barge. An undesirable slipping of the sand can be prevented almost perfectly by the upper rubber member.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE PREFERRED EMBODIMENTS

Figure 1:
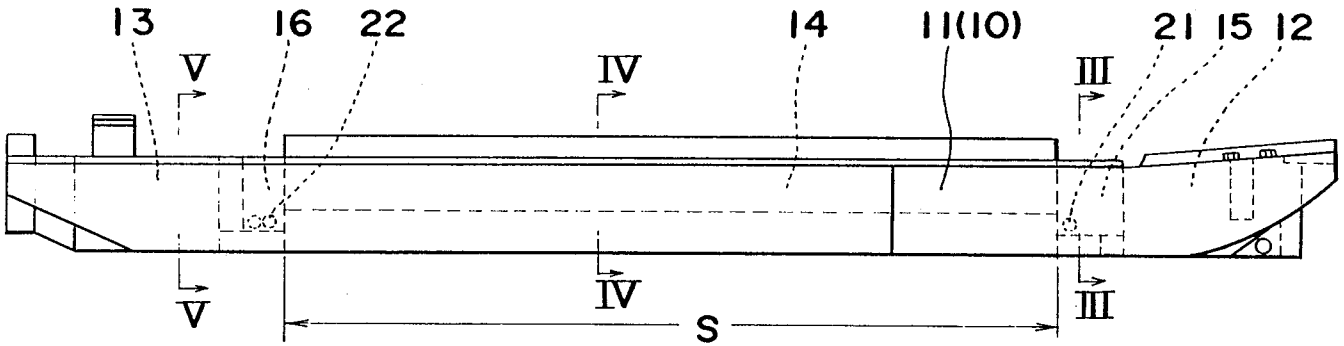
FIG. 1 is a side elevational view of a carrying barge according to a first embodiment of the present invention.
Figure 2:
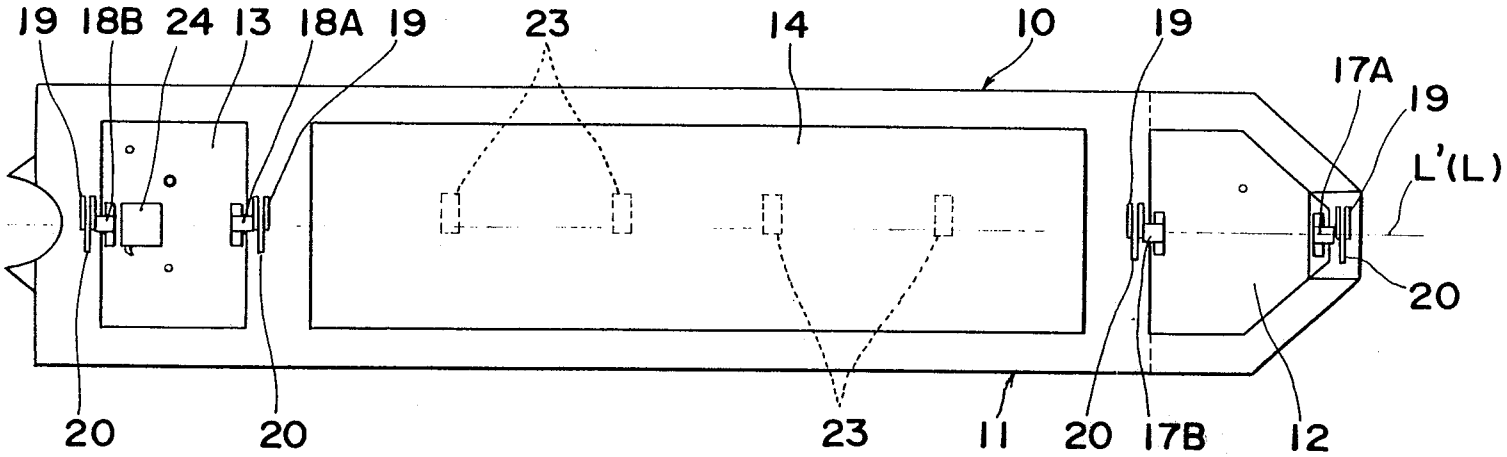
FIG. 2 is a plan view of FIG. 1.

Before the description of the present invention proceeds, it is to be noted that the like parts are designated by the like reference numerals throughout the accompanying drawings.

Figure 3:
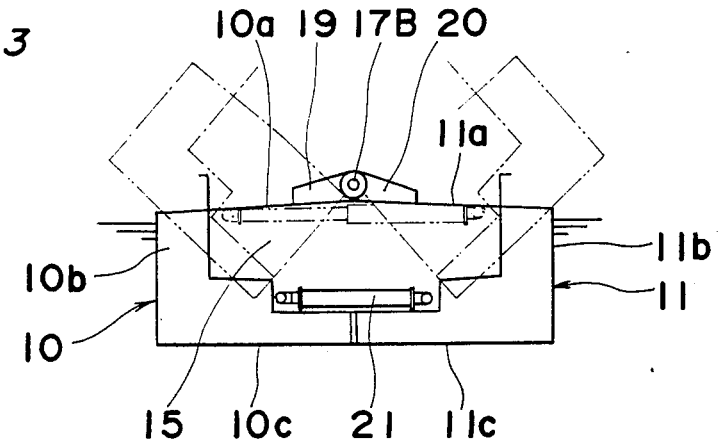
FIG. 3 is a cross-sectional view taken along the line III—III of FIG. 1.
Figure 19:
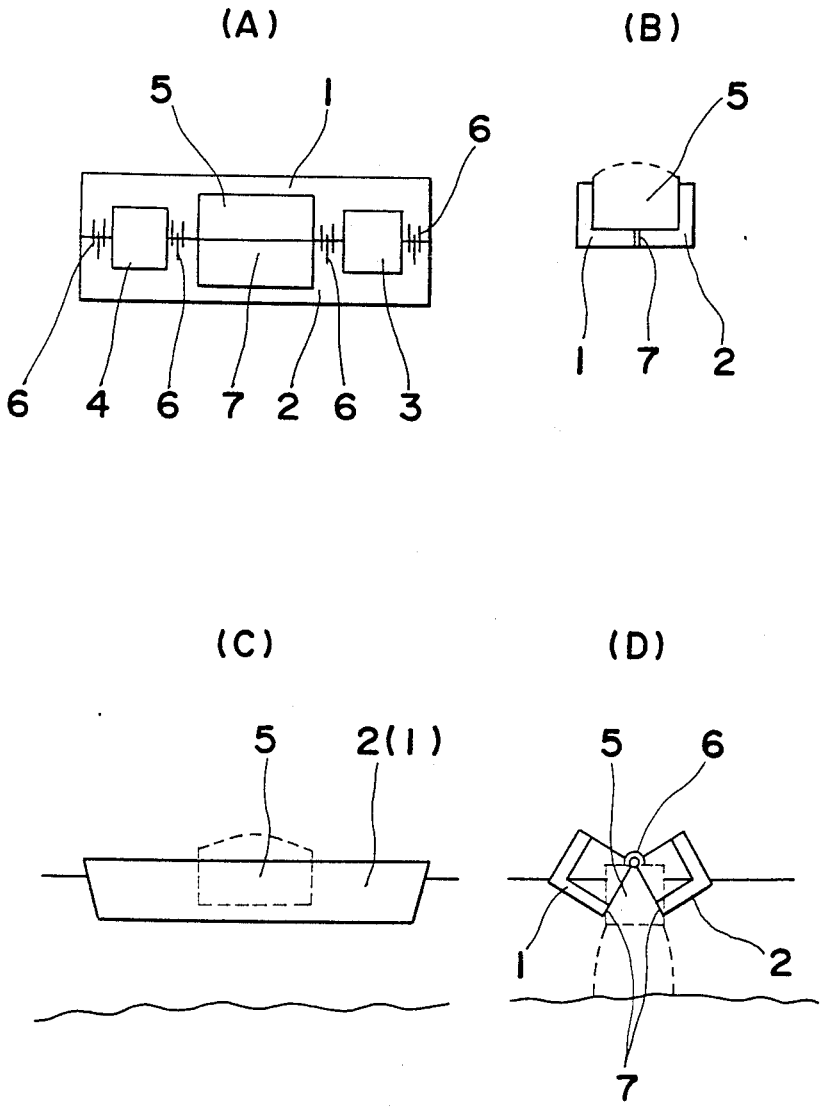
Fig. 19 PRIOR ART
FIG. 19 is a prior art carrying barge, FIG. 19(A) being a plan view, FIG. 19(B) being a schematic cross-sectional view when the hold is closed, FIG. 19(C) being a front elevational view and FIG. 19(D) being a schematic cross-sectional view when the loads are thrown away.

Referring to FIGS. 1 to 6, a two-split type of carrying barge shown therein is the same lighter employing a center hinge as shown in FIG. 19. The carrying barge includes left and right parts of the hull 10 and 11 which are rotatable members, fixed front and rear parts of the hull 12 and 13 at the bow side and at the stern side, respectively, forming a machine chamber, etc., and a hold 14 defined by the left and right parts of the hull 10 and 11. The above left part of the hull 10 is formed by an upper part 10*a* constituting the left half of the upper surface of the hull of the barge, a side part 10*b* constituting the left side part of the hull, and a bottom part 10*c* constituting the left half of the bottom surface of the hull of the barge. The side part 10*a* and the bottom part 10*c* are hollow defining a room thereinside. Moreover, all of the upper, side and bottom parts 10*a*, 10*b* and 10*c* are arranged to be rotated together. Likewise, the right part of the hull 11 is comprised of an upper part 11*a*, a side part 11*b* and a bottom part 11c. The rotatable left and right parts of the hull 10 and 11 are arranged to be in contact with each other at the center line L' of the upper surface of the hull and at the center line L of the bottom of the carrying barge. The left and right parts of the hull 10 and 11 at the respective bow side and the stern side are shaped so as to surround the fixed parts of the hull 12 and 13. The hold 14 is defined between the fixed parts of the hull 12 and 13 via cylinder divisions 15 and 16. Above the fixed parts of the hull 12 and 13, supporting shafts 17A and 17B and, 18A and 18B protruded from the front and rear ends of each of the hull parts 12 and 13 toward the rotatable hulls 10 and 11. A hinge 19 is provided between each of the supporting shafts 17A–18B and the upper part 10*a* of the left rotatable hull 10, and a hinge 20 is provided between each of the supporting shafts 17A–18B and the upper part 11*a* of the right hull 11. As shown in FIG. 3, a stepped portion is formed in each of the bottom pats 10*c* and 11*c* in the cylinder divisions 15 and 16 the main hydraulic cylinders 21 and being disposed in the stepped portions for opening or closing the hold. Accordingly, by extending the rods of the hydraulic cylinders 21 and 22, the left and right hulls 10 and 11 are rotated at the fulcrum of the hinges 19 and 20, and consequently the end portions of the hulls 10 and 11 are separated from each other at the center line L, to open the hold 14.

There are many coupling means 23 arranged with some distance therebetween in the lengthwise direction of the hold 14 between the end portions of the bottom parts 10*c* and 11*c* which are engageable and separable at the center line L of the hold 14. When the length S of the hold 14 is large, many coupling means are necessary. On the contrary, if the length S of the hold 14 is short, a single coupling means may be enough. It is to be noted here that the total length of the carrying barge according to the first embodiment is 930 m, the length S of the hold 14 is 54 m, and four coupling means are mounted in the carrying barge at a predetermined distance from one another.

The above-described coupling means 23 may embody any suitable structure that couples two coupling portions (left and right hulls 10 and 11) detachably, for example, a coupler of a train.

According to the present embodiment, the coupling means 23 is arranged to be locked or released by a remote control simply by depressing an operation switch (not shown) provided in a machine chamber 24 of the fixed hull 13 at the stern side.

Figure 6:
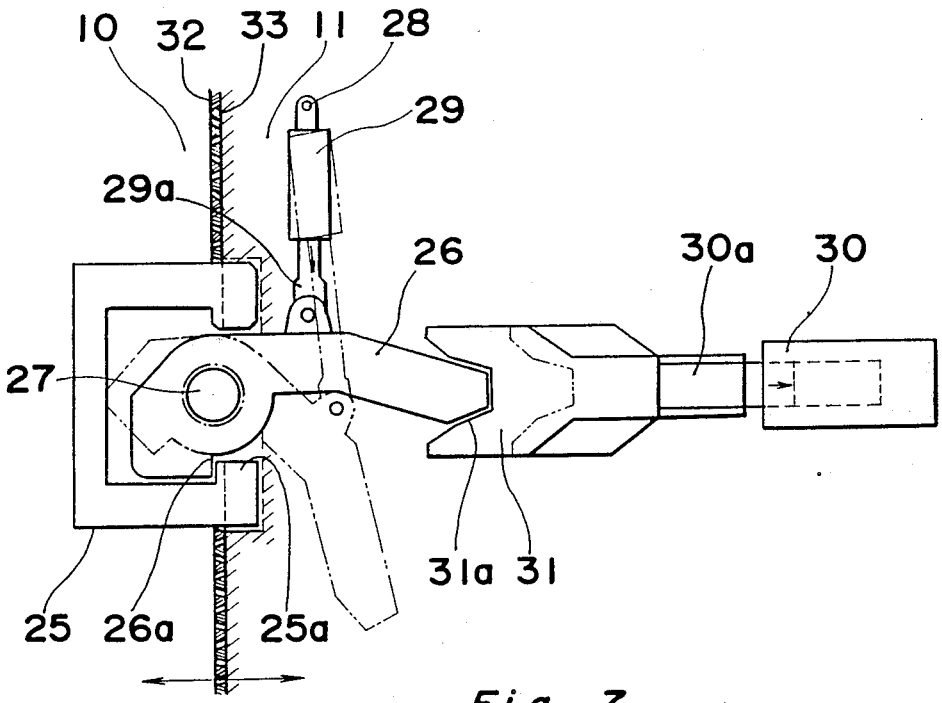
FIG. 6 is an enlarged view of a coupling means employed in the carrying barge of FIG. 1.

The coupling means 23 of the carrying barge of the first embodiment has a structure as shown in FIG. 6, with a lock hole 25 secured to the end of the bottom part 10*c* of the left hull 10. The lock hole 25 generally has a recessed configuration and an engaging portion 25*a* protruding inwards at the end thereof. A lock lever 26 is rotatably supported by a supporting shaft 27 at the bottom part 11*c* of the right hull 11 opposite to the lock hole 25. The lever 26 is supported so as to be guided in the engaging portion 25*a* when the coupling means 23 is locked. If one side of the lock lever 26 is driven into the lock hole 25, a bending lock portion 26*a* formed at the front end of the lock lever 26 is engaged with the engaging portion 25*a* of the lock hole 25, so that the left and right hulls 10 and 11 are locked. The other side of the lock lever 26 is coupled to a rod 29*a* of a hydraulic cylinder 29 which is rotatably supported by a supporting shaft 28 to rotate the lock lever. The lock lever 26 is rotated by the extension-retraction and rotating movement of the rod 29*a*. Another hydraulic cylinder 30 is fixedly provided on the same line as the supporting shaft 27, and a cylinder head 31 for stopping the rotation of the lock lever 26 is mounted at the end of a rod 30*a* of the hydraulicc cylinder 30. The cylinder head 31 has a recessed portion 31*a* into which is fitted an end portion 26*b* of the lock lever 26, and accordingly, when the end portion 26*a* of the lock lever 26 is engaged with the engaging portion 25*a* of the lock hole 25, the end portion 26*b* is fitted into the recessed portion 31*a* to prevent the rotation of the lock lever 26. Each of the hydraulic cylinders 29 and 30 is driven by an electromagnetic valve (not shown) placed in the piping, which valve is remote-controlled from the machine chamber.

Rubber packings 32 and 33 are seated along the surfaces of the end portions of the bottom parts 10*c* and 11*c* coupled by the coupling means 23. These rubber packings 32 and 33 ensure the watertightness of the carrying barge while the hold 14 is closed.

Hereinbelow, the opening and closing operation of the hold 14 in the carrying barge of the first embodiment will be desccribed in detail.

Figure 4:
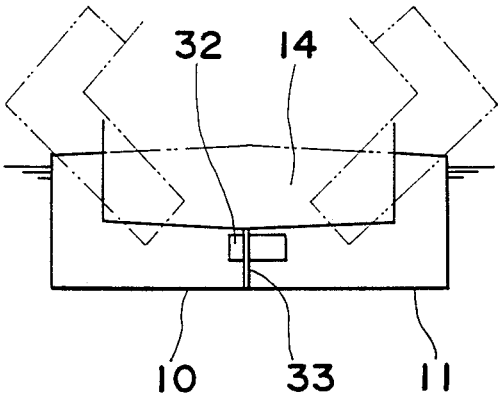
FIG. 4 is a cross-sectional view taken along the line IV—IV of FIG. 1.
Figure 5:
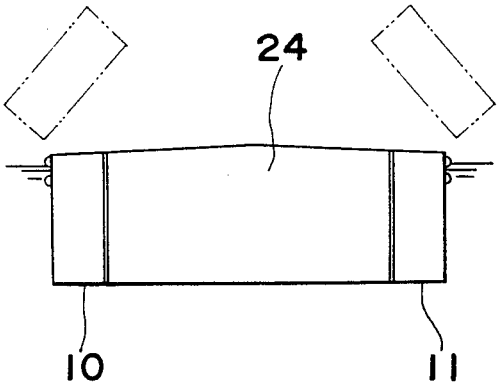
FIG. 5 is a cross-sectional view taken along the line V—V of FIG. 1.

When the hold 14 is closed, the left and right hulls 10 and 11 are in the position as shown by a solid line in FIGS. 3 to 5, and each part of the coupling means 23 is in the position shown by a solid line in FIG. 6. Since, while the hold 14 is closed, the left and right hulls 10 and 11 are tightly locked by the coupling means 23 separated a given distance from one another along the center line L of the bottom of the barge which is to be opened, the left and right hulls 10 and 11 can be prevented from being curved individually in a different manner during navigation or upon the receipt of shocks. The left and right hulls 10 and 11 are prevented from being separated from each other at the center line of the bottom of the barge to open the hold 14, while the waterlightness is maintained by the rubber packings 32 and 33. As a result, the loads in the hold 14 can be prevented from getting wet.

On the other hand, when the carrying barge is stopped at a predetermined position to open the gold 14 for expelling the load in the hold, first, the hydraulic cylinder 30 is operated and the rod 30*a* is retracted to return back to the position shown by a chain line in FIG. 6, so that the recessed portion 31*a* of the cylinder head 31 is released from the end portion 26*b* of the lock lever 26. Then, when the rod 29*a* of the cylinder 29 is extended to the position shown by a one-dot chain line in FIG. 6, the lock lever 26 is rotated in a clockwise direction to release the lock portion 26*a* from the engaging portion 25*a* of the lock hole 25. Therefore, as shown by the one-dot chain line, the lock lever 26 is in a state in which it may be withdrawn through the entrance of the lock hole 25. After the lock lever 26 is brought to the aforementioned state, the rods of the main hydraulic cylinders 21 and 22 provided in the cylinder divisions 15 and 16 are extended, and the left and right hulls 10 and 11 are rotated at the fulcrum of the hinges 19 and 20 of the supporting shafts 17A–18B as shown in FIG. 3. Because of the rotation of the hulls 10 and 11 as described above, the distance between the ends of the contacted bottom portions 10*c* and 11*c* is gradually enlarged, opening the bottom of the hold 14 at the center line L. At this time, in accordance with the movement of the left and right hulls 10 and 11, the lock hole 25 and lock lever 26 are separated from each other. The lock lever 26 is withdrawn through the entrance of the lock hole 25 and the coupling means 23 is released. In the manner described above, when the hold 14 is opened, the loaded cargo is expelled from the hold 14.

When the hold 14 is desired to be closed after the load is expelled the closing operation is carried out in reverse order to the order of the above opening operation. In other words, the left and right hulls 10 and 11 are rotated to shut the ends of the bottom parts 10*c* and 11*c* by the main hydraulic cylinders 21 and 22, and then, the lock lever 26 is rotated in a counterclockwise direction by the cylinder 29 of the coupling means 23, so that the lock portion 26*a* is engaged with the lock hole 25. In the above state, the cylinder head 31 is advanced by the cylinder 30 to be fitted into the lock lever 26 for locking the hulls.

Figure 7:
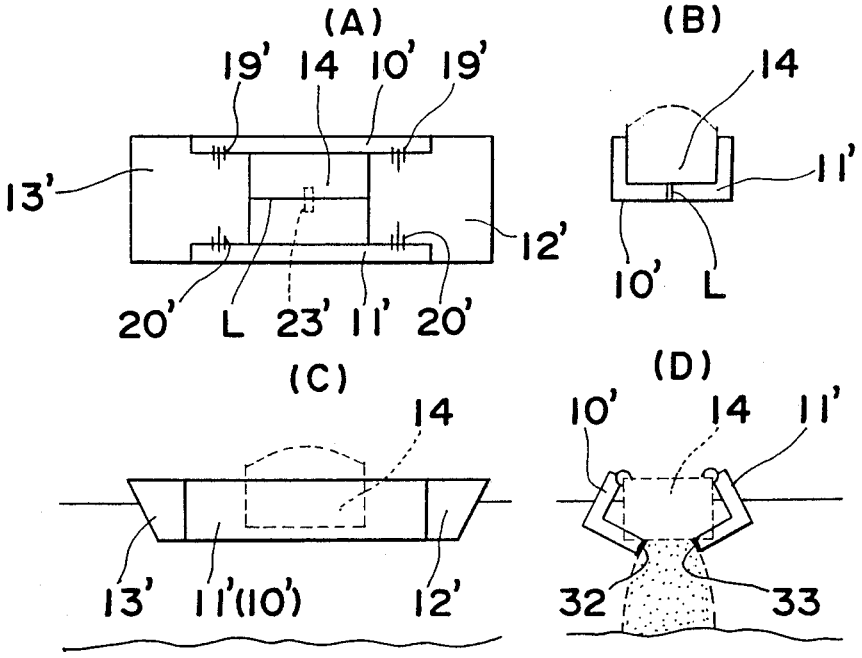
FIG. 7 is a modified example of a carrying barge of the present invention employing a side hinge, FIG. 7(A) being a plan view, FIG. 7(B) being a schematic cross-sectional view when a hold is closed, FIG. 7(C) being a front elevational view, and FIG. 7(D) being a schematic cross-sectional view when a load is expelled.
Figure 8:
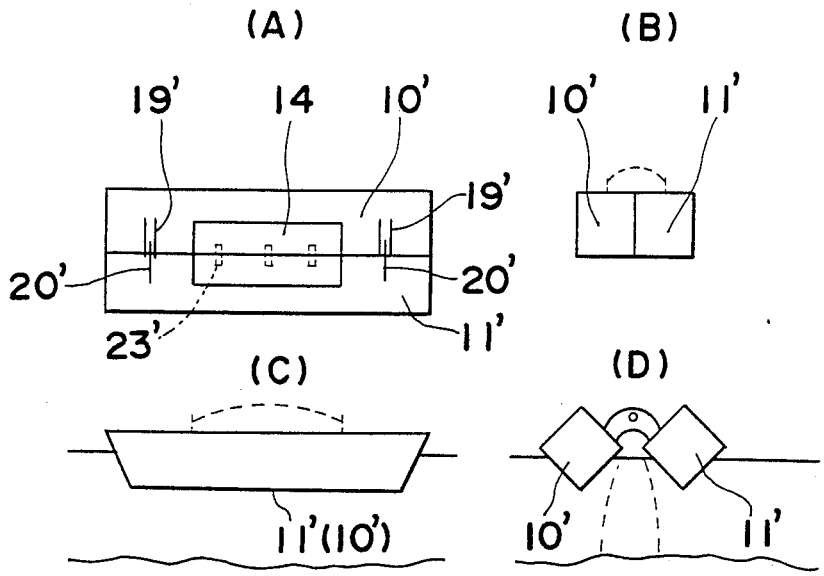
FIG. 8 is a modified example of a carrying barge of the present invention employing a center hinge, FIG. 8(A) being a plan view, FIG. 8(B) being a side elevational view, FIG. 8(C) being a front elevational view, and FIG. 8(D) being a schematic cross--sectional view when the load is expelled.

It is needless to sau that the present invention is not restricted to the above-described embodiment, that is, a two-split type carrying barge employing a center hinge, but, it is applicable also to a two-split type carrying barge employing a side hinge as shown in FIG. 7 or a two-split type carrying barge employing a center hinge as shown in FIG. 8. In the carrying barge of FIGS. 7 and 8, reference numerals 10' and 11' represent left and right parts of the hull, 12' and 13' being fixed parts of the hull, 19' and 20' being hinges and 23' being a coupling means.

As is clear from the foregoing description, in the two-split type carrying barge according to the present invention, the left and right hulls of the barge are arranged to be coupled by coupling means which are separated a predetermined distance from one another in the lengthwise direction of the hold along the center line of the bottom of the barge, and therefore the water tightness of the barge at the bottom thereof which is to be opened or closed for expelling a load can be positively secured. Accordingly, the length S of the hold is able to be longer as compared to the prior art. More specifically, although the hold of the conventional carrying boat is approximately 30 m long at most, it can be 50–60 m according to the present invention. In addition, the maximum loading capacity in the conventional boat is 2–3000 tons, while the carrying barge of the present invention can accommodate a load of 2–5000 tons.

Moreover, the carrying barge according to the present invention is extremely advantageous since the coupling means can be operated considerably easily by remote control using an operating switch.

A coupling means of a carrying barge according to a second embodiment of the present invention will be described hereinbelow with reference to FIGS. 9 to 11.

Figure 10:
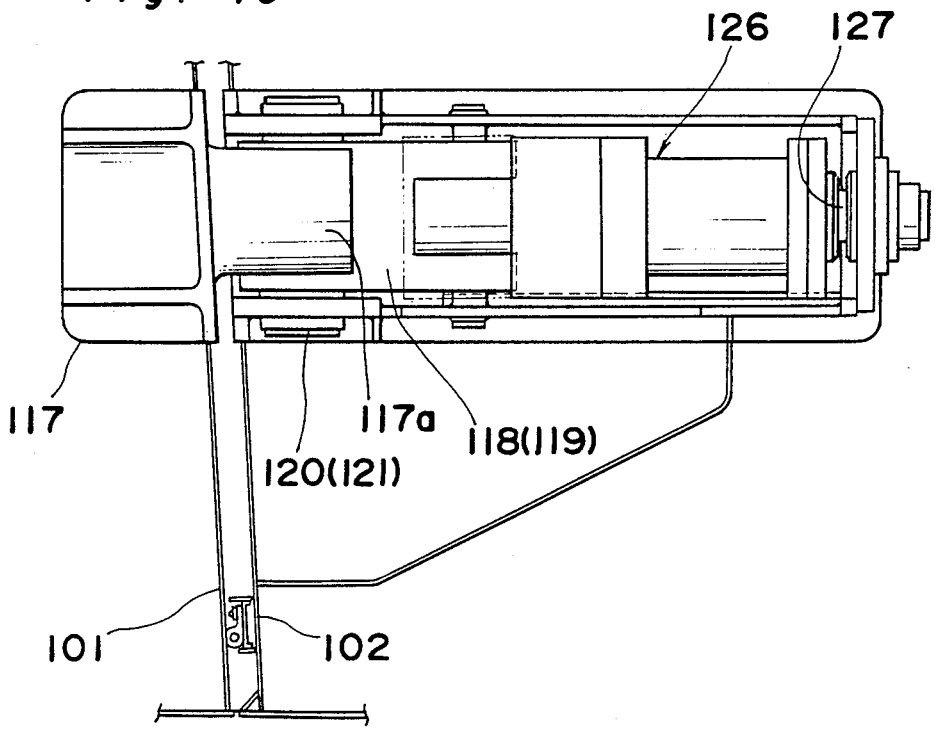
FIG. 10 is a side elevational view of the coupling means of FIG. 9.
Figure 9:
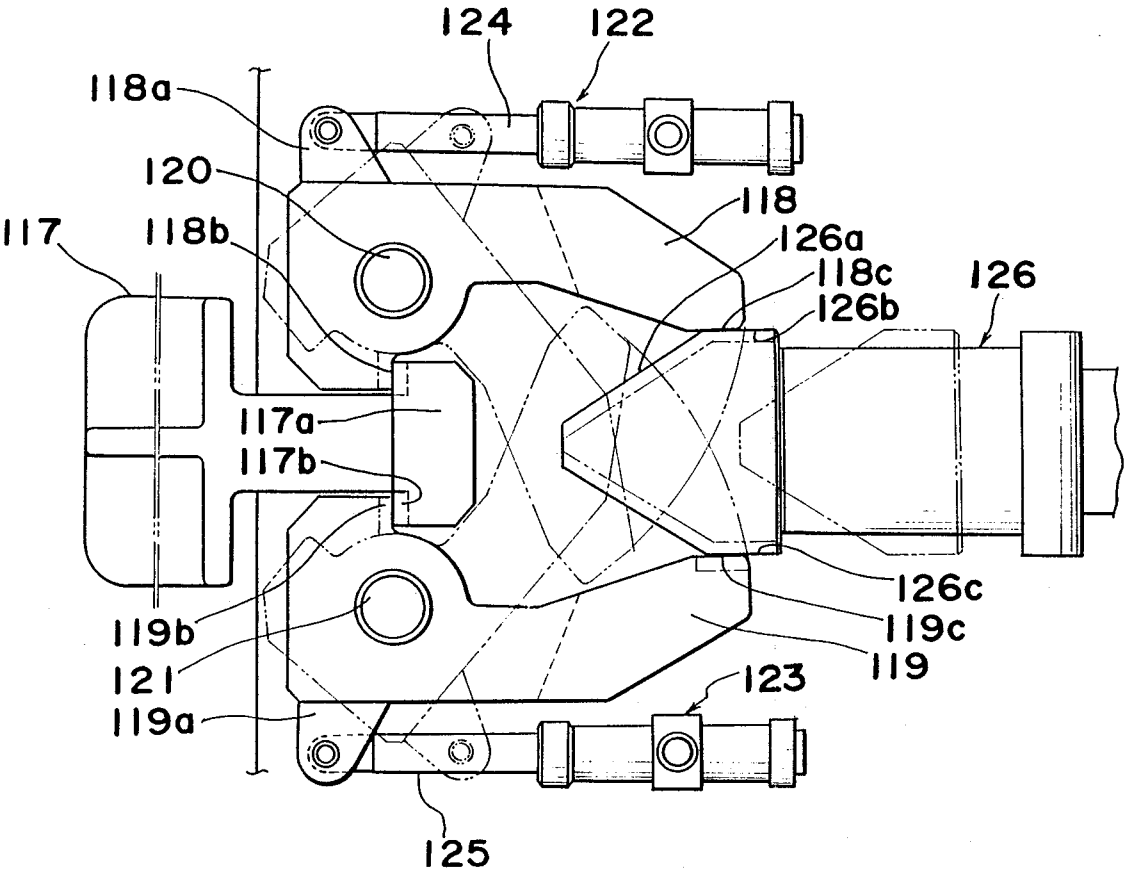
FIG. 9 is a plan view of a coupling means of a carrying barge according to a second embodiment of the present invention.

A coupling means 115 shown in FIGS. 9 and 10 is arranged to be locked or released by remote control by the depression of an operating switch (not shown) provided in a machine room 116 in a fixed hull 104 at the stern side of the barge.

The coupling means 115 has a to-be-clamped metal fitting 117 fixed at the end of the bottom portion of a left hull 101. The metal fitting 117 has a configuration as shown in FIGS. 9 and 10 including a T-shaped engaging portion 117*a* projecting from the end of the bottom portion of the hull. On the other hand, at the bottom portion of a right hull 102, a pair of clamp arms 118 and 119 which clamp the engaging portion 117*a* of the metal fitting 117 from opposite sides are rotatably supported by supporting shafts 120 and 121, respectively. The clamp arms 118 and 119 have respective brackets 118*a* and 119*a* projecting from the outer surface to which are rotatably connected piston rods 124 and 125 of arm opening cylinders 122 and 123. When the piston rods 124 and 125 are extended, engaging portions 118*b* and 119*b* projecting from respective ends of the clamp arms 118 and 119 are engaged with an engaging surface 117*b* of the engaging portion 117*a*, as shown by a solid line in FIG. 9. When the piston rods 124 and 125 are retracted, the clamp arms 118 and 119 are rotated to positions shown by a one-dot chain line, releasing the engaging portions 118*b* and 119*b* from the engaging portion 117*a* of the metal fitting 117. In order to maintain the locked condition of the clamp arms 118 and 119 and the metal fitting 117, a clamp cylinder 126 is removably inserted between the clamp arms 118 and 119 at the side opposite the metal fitting side. Also provided is a piston rod 127 fitted in an inner cylinder chamber of the clamp cylinder 126 and projecting from the base side of the cylinder 126, the end of which is fixed to the bottom portion of the right hull 102. Accordingly, the clamp cylinder 126 is extended and retracted by the supply and exhaust of oil in and from the cylinder chamber. As shown in FIG. 9, a locking portion 126*a* is formed at the end of the clamp cylinder 126. When the clamp cylinder 126 is extended, the locking portion 126*a* is inserted between the clamp arms 118 and 119 at the base side, and consequently engaging surfaces 126*b* and 126*c* of the locking portion 126*a* are engaged with the engaging surfaces 118*c* and 119*c* defined at the inner surfaces of the clamp arms 118 and 119 at the base side respectively, to stop the rotation of the clamp arms 118 and 119. On the other hand, when the clamp cylinder 126 is retracted, the locking portion 126*a* is disengaged from the clamp arms 118 and 119 at the base side, so that the clamp arms 118 and 119 become rotatable.

Figure 11:
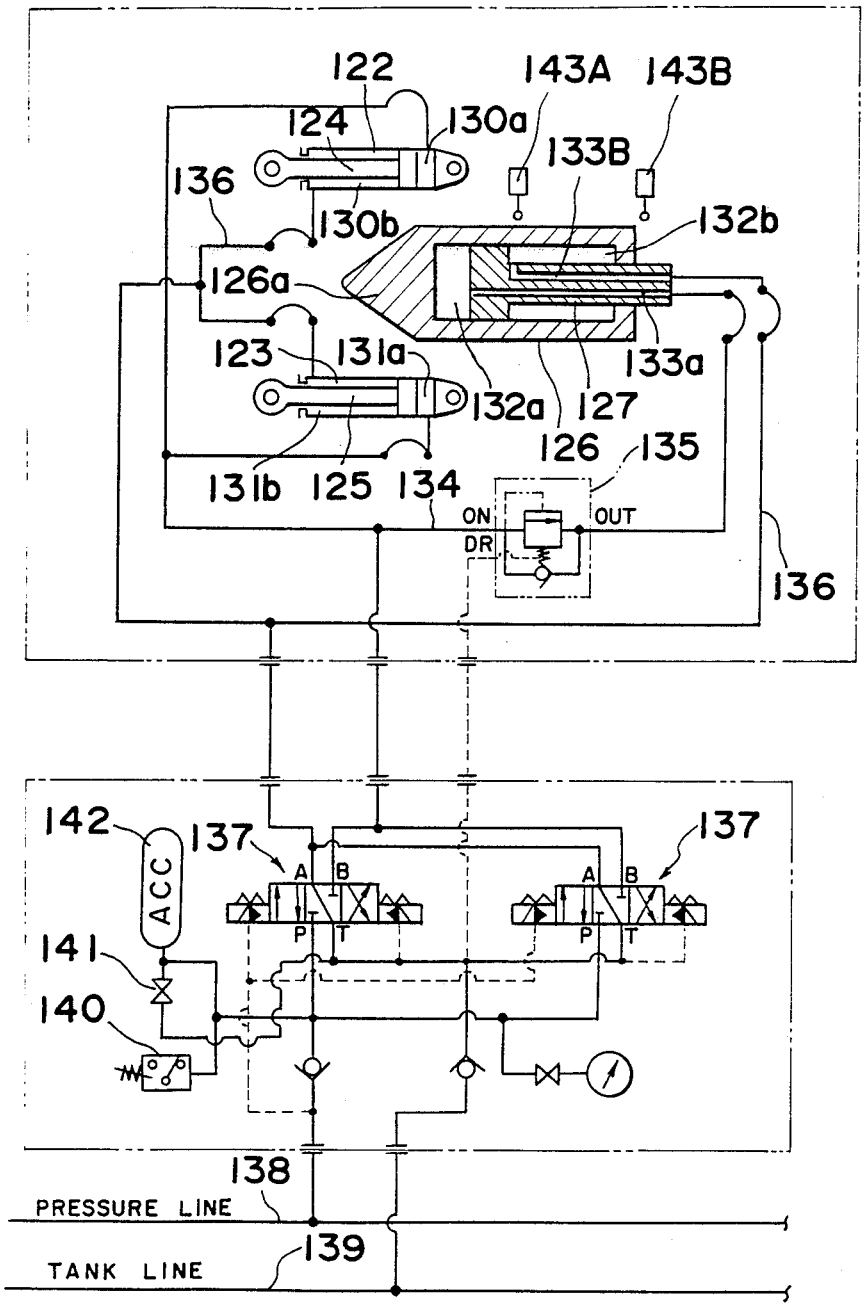
FIG. 11 is a diagram showing the relation of the coupling means and a hydraulic circuit.

All of the above-described clamp cylinder 126 and the arm opening cylinders 122 and 123 are linked by a hydraulic circuit shown in FIG. 11. The following description will be directed to this hydraulic circuit of FIG. 11.

Cylinder chambers 130*a* and 131*a* respectively defined by the piston rods 124 and 125 of the cylinders 122 and 123 communicate, through a duct line 134 and a passage 133*a* formed within a piston rod 127, with a cylinder chamber 132*a* defined by the piston rod 127 of the clamp cylinder 126. A sequence valve 135 is provided in the duct line 134. On the other hand, the other cylinder chambers 130*b* and 131*b* of the cylinders 122 and 123 communicate with a cylinder chamber 132*b* of the clamp cylinder 126 via a conduit or a duct line 136 and a passage 133*b* within the piston rod 127.

The above-described circuit 134 communicates with each B port of two solenoid valves 137 arranged in parallel for 4-port 3-position switching, while the conduit 136 communicates with an A port of each of the solenoid valves 137. A P port of the solenoid valve 137 communicates with a pressure line 138, and T port communicates with a tank line 139. A pressure switch 140, a stop valve 141 and an accumulator 142 are disposed between the solenoids 137 and the pressure line 138 so as to regulate the pressure of the oil to be supplied to the cylinders 122, 123 and 125 to a predetermined valve. The above solenoids 137 are automatically switched by a detection signal issued by limit switches 143A and 143B which detect the moving distance of the clamp cylinder 126.

It is to be noted here that rubber packings 150 and 151 are mounted along the end surfaces of the bottom portions of the left and right hulls 101 and 102 which are coupled by the coupling means 115. Therefore, when the hold 105 is closed, these rubber packings 150 and 151 ensure watertightness of the hulls.

The operation of coupling means 115 having the above-described structure will be described below.

In the state shown by the solid lines in FIGS. 9 and 10 where the coupling means 115 is locked, the solenoid valves 137 of the hydraulic circuit are in the neutral position, with the ports A and T openly communicating with each other. In this state, oil is fully accommodated in the cylinder chambers 130*a* and 131*a* of the respective cylinders 122 and 123, and simultaneously both the cylinder chambers 130*b* and 131*b* openly communicate with the tank line 139. The piston rods 124 and 125 are stopped in the advanced position. Consequently, the clamp arms 118 and 119 coupled to the piston rods 124 and 125 clamp the metal fitting 117 at the position shown in the drawing. At the same time, the cylinder chamber 132*a* of the clamp cylinder 126 is full of oil, and the cylinder chamber 132*b* openly communicates with the tank line 139. Accordingly, the clamp cylinder 126 is brought to the advanced position, the locking portion 126*a* of which accordingly locks the clamp arms 118 and 119 in such a manner as to not be able to be rotated.

If the loaded cargo is desired to be expelled from the hold 105, the remote control switch provided in the machine chamber 116 is turned ON. The solenoid valves 137 are switched to the right in FIG. 11 because of the avobe-described operation of the remote control switch, and the ports P and A, and the ports T and B openly communicate with each other. As a result, the oil pressure is supplied from the duct line 136 into the cylinder chamber 132*b* of the clamp cylinder 126, and at the same time, the oil in the cylinder chamber 132*a* is returned to the tank line 139, so that the clamp cylinder 126 is retracted and disengaged from the clamp arms 118 and 119 which are in turn brought into the rotatable condition. Simultaneously, oil pressure is supplied to the cylinder chambers 130*b* and 131*b* of the respective cylinders 122 and 123, and furthermore, oil in each of the cylinder chambers 130*a* and 131*a* is returned to the tank line 139. Then, the piston rods 124 and 125 are accordingly retracted. In accordance with the retraction of the piston rods 124 and 125, as was described earlier, since the clamp arms 118 and 119 are released by the clamp cylinder 126, clamp arm 118 is rotated in the clockwise direction at the fulcrum of the supporting shaft 120 and clamp arm 119 is rotated in the counterclockwise direction at the fulcrum of the supporting shaft 121 as shown by the one-dot chain line in FIG. 9, to release the metal fitting 117 from by engaging portions 118*b* and 119*b*.

When the hydraulic cylinder 112 provided between the left and right hulls 101 and 102 is driven to extend the rods 124 and 125 while the coupling means 115 is released, both of the hulls 101 and 102 are rotated, gradually opening the end portions of the hulls at the bottom of the barge, so that the metal fitting is withdrawn from between the clamp arms 118 and 119.

When the hold 105 is to be closed after the load has been expelled, the hydraulic cylinder 112 is driven to close the bottoms of the hulls 101 and 102. When the end portions at the bottoms of the hulls 101 and 102 are closed by the packings, the metal fitting 117 is projected to the side of the left hull 101 to be placed between the clamp arms 118 and 119 in the position shown by the one-dot chain line in FIG. 9. Thereafter, by turning ON the closing switch of the coupling means by remote control, the solenoid valves 137 are moved to the left in FIG. 11, with the ports P and B, and the ports T and A openly communicating with each other, respectively. Accordingly, the oil is supplied or taken out of the cylinders 122, 123 and 126, contrary to the case when the hold is opened, and the piston rods 124 and 125 are moved forward. The clamp cylinder 126 is also advanced. At this time, oil pressure is supplied to the cylinders 122 and 123 through the sequence valve 135 in the conduit 134 to move the piston rods 124 and 125, and then oil pressure is supplied to the clamp cylinder 126 which is consequently advanced. Accordingly, the clamp arms 118 and 119 are rotated respectively in the direction opposite to that during the opening of the hulls without being interrupted by the clamp cylinder 126. The engaging portions 118*b* and 119*b* clamp onto the metal fitting 117. Thereafter, the clamp cylinder 126 is advanced inbetween the clamp arms 118 and 119 to be locked. When the clamp cylinder 126 is advanced a predetermined distance to the locking position, the limit switch 143B detects this fact, so that the solenoid valves 137 are automatically switched to the neutral position, thereby securing the clamped condition.

Figure 12:
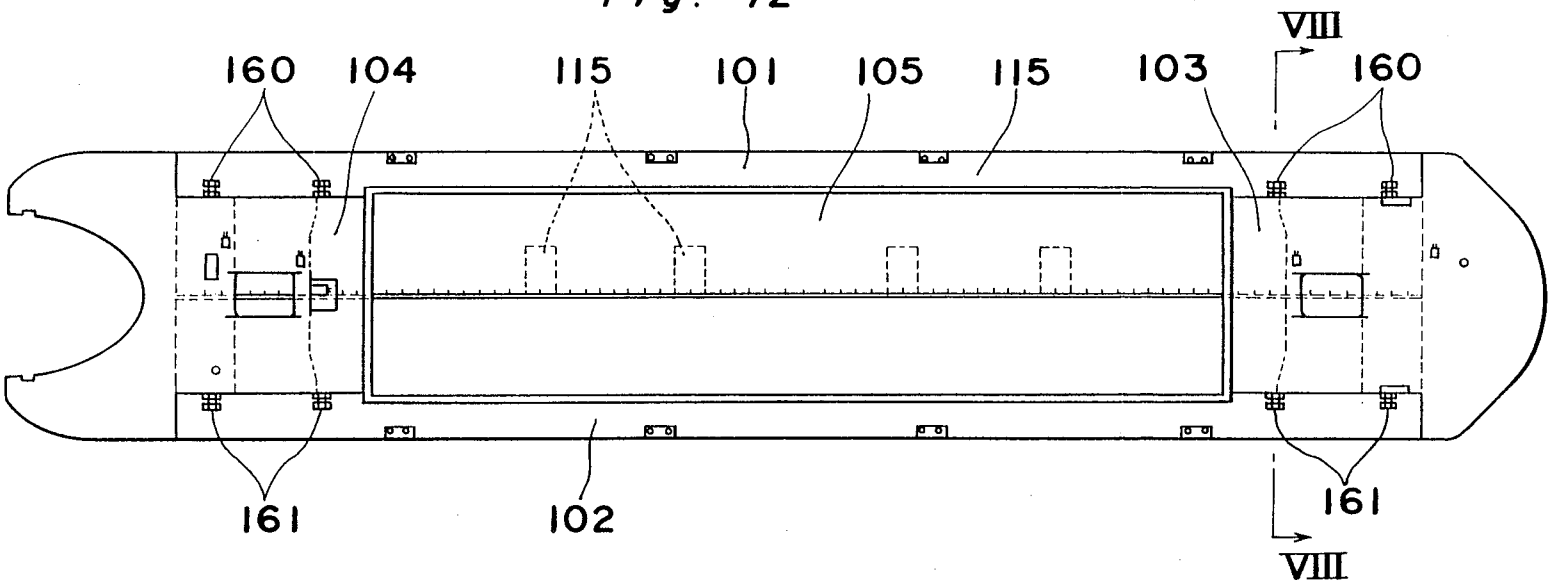
FIG. 12 is a plan view of as modified version of the carrying barge according to the present invention.
Figure 13:
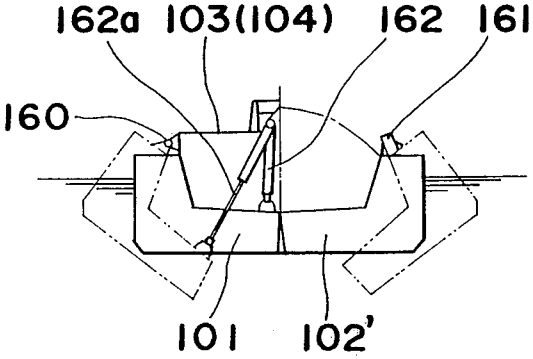
FIG. 13 is a cross-sectional view taken along the line VIII—VIII of FIG. 12.

It is needless to say that the present invention is not restricted to the above-described embodiment, but can be modified as shown in FIGS. 12 and 13 wherein the left and right hulls 101 and 102 are rotatably supported on the fixed hulls 103 and 104. In other words, according to the a modified embodiment of the present invention shown in FIGS. 12 and 13, the left and right side portions of the fixed hulls 103 and 104 are pivotably connected with the upper end portions of the left and right hulls 101 and 102 by hinges 160 and 161. Moreover, for opening or closing the left and right hulls 101 and 102, a hydraulic cylinder 162 is provided between the upper plates of each of the fixed hulls 103 and 104 and the bottom portion of each of the left and right hulls 101 and 102. As shown in FIG. 13, the base of the hydraulic cylinder 162 is rotatably provided at the fixed hull 103 or 104, and at the same time, the end of a downwardly projecting cylinder rod 162*a* of the cylinder 162 is rotatably provided at the opening portion of the bottom of the left and right hulls 101 and 102. Therefore, if the cylinder rod 162*a* is extended, the hulls 101 and 102 are moved as shown by a one-dot chain line in FIG. 13, thus opening the hold 105. On the contrary, when the cylinder rod 162*a* is retracted, the hold 105 is closed.

Accordingly, the coupling means of the present invention is most suitable for coupling the left and right hulls of the carrying barge which are arranged to be separated at the bottom of the hold along the center line thereof like double doors. As described above, the coupling means employed in the two-split type carrying barge of the present invention is comprised of one unit of a pair of clamp arms driven by separate hydraulic cylinders, and a hydraulic clamp cylinder, in which the pair of clamp arms clamp onto a metal fitting from opposite sides thereof with sa large force. Moreover, a locking portion is integrally formed at a part of the clamp cylinder to be engaged with the pair of clamp arms, so that the clamp arms can be locked in the clamped position under a strong force and are prevented from being rotated. Thus, according to the present invention, since the left and right hulls are coupled by the coupling means with a strong force, which coupling means are arranged a predetermined distance from one another along the center of the bottom of the barge, the watertightness at the opening portion of the bottom of the barge can be positively secured. Therefore, the hold can be longer than in the prior art, having a much increased loading capacity. Moreover, the coupling means can be easily operated by remote control by the operation of a switch.

Figure 14:
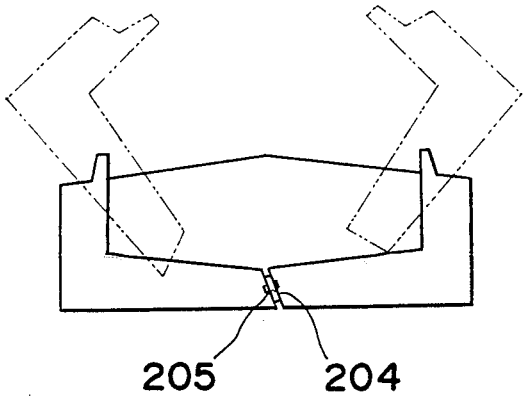
FIG. 14 is a cross-sectional view of a modification of a hold of a bottom opening type of carrying barge according to the present invention.
Figure 15:
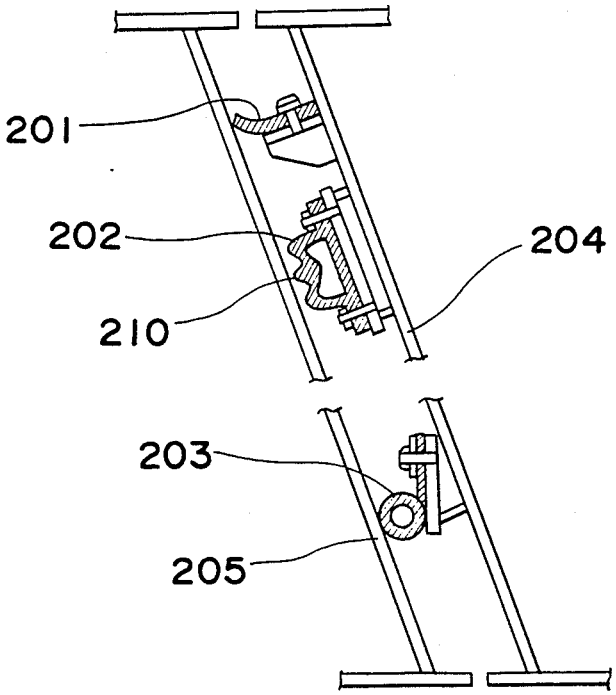
FIG. 15 is an enlarged view of an opening portion of the hold of FIG. 14.
Figure 16:
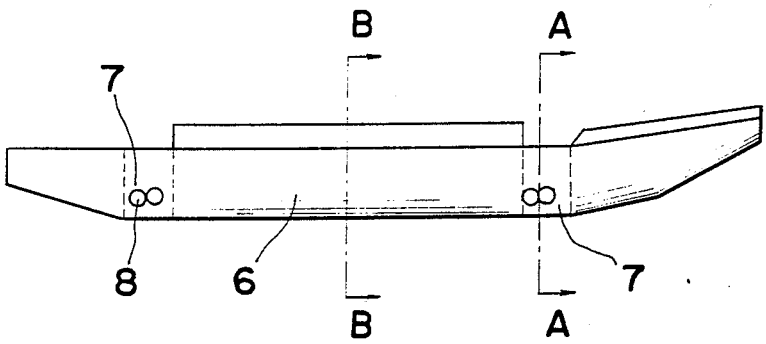
FIG. 16 ia a side elevational view of the carrying barge of a bottom opening type of FIG. 14.
Figure 17:
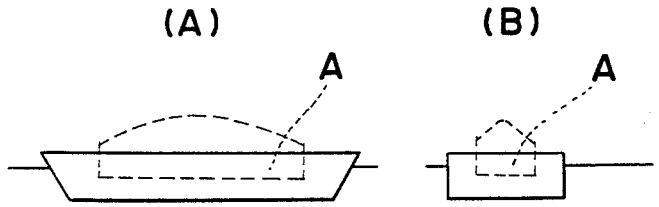
Fig. 17 PRIOR ART
FIG. 17 is a prior art carrying barge, FIG. 17(A) being a front elevational view and FIG. 17(B) being a side elevational view.
Figure 18:
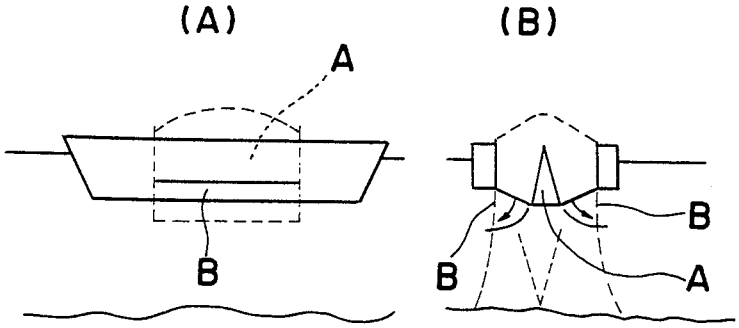
Fig. 18 PRIOR ART
FIG. 18 is a prior art carrying barge,FIG. 18(A) being a front elevational view and FIG. 18(B) being a schematic cross-sectional view showing the state when the load is expelled from the barge.

FIGS. 14 to 16 show a modified example of the hold in a two-split type carrying barge (bottom opening model) according to the present invention.

As shown in FIGS. 14 and 15, a plate-like rubber packing 201 is provided in the upper part of an upper surface of the opening portion having predetermined angles of inclination with respect to the bottom of the barge. Further, below the rubber material 201 is provided a rubber packing 202 which is hollow so as to be filled with liquid or gas. In the lowest part of the opening portion, a tubular rubber material 203 is provided. The hold includes the above-described packing arrangement. When sand or the like is to be loaded in the barge, the opening portion is closed to be locked. At this time, the rubber packings 201 and 203 are in contact with the other lower surface of the opening portion. Thereafter, water or air is passed into the rubber piece 202 which is in turn pressed against an opposite surface 205. Then, the sand is loaded. If the loaded sand is to be expelled, the pressure in the rubber piece 202 is relieved and the rubber piece 202 contracts. Then, the opening portion is opened to expel the sand. The rubber packings 201, 202 and 203 are made of elastic material, for example, rubber or synthetic resin, etc. and may be sometimes used together with reinforced materials such as cloth, etc.

Accordingly, the loaded sand can slide down along the opposite surface 205 of the opening portion inclined at predetermined angles with respect to the bottom of the barge, resulting in a reduction in shocks imparted to the barge when the sand is expelled in comparison with the case in which the sand is expelled merely vertically out of the opening portion. Also, most of the sand can be prevented by the upper packing 201 from inadvertently slipping out of the opening portion.

The main packing 202 is hollow as shown in FIG. 15. Therefore, when the water or the air is passed into the packing 202, a central part 210 of the main packing 202 expands outwardly. Accordingly, the main packing 202 can widely cope with a change of its thickness. Even when the distance between the upper and lower surfaces 204 and 205 of the opening portion is changed because of pitching or rolling, the main packing can perfectly follow the change.

Since the lower part of the opening portion is inclined at predetermined angles with respect to the bottom of the barge, and although it is in contact with the sea water, the lower part receives less shocks imparted by the sea as compared to when the lower part is vertical with respect to the bottom of the barge. Further, the lower packing 203 can prevent the sea water from leaking into the barge.

As described hereinabove, according to the packing arrangement of the present invention, the sand or the like can be prevented by the upper packing 201 from inadvertently slipping out of the hold, and the sea water water can be prevented from leaking into the barge by the lower packing 203, and moreover the main packing 202 ensures the sealing effects. Moreover, since the surfaces of the opening portion are inclined with respect to the bottom of the barge, the shocks imparted to the barge when the sand is expelled from the opening portion can be reduced, resulting in less damage to the packings. Since the main packing 202 is contracted when the sand is expelled, and almost shielded by the upper packing 201, the main packing 202 is prevented from being damaged. Further, the packing arrangement uses three packings 201, 202 and 203, each of which can be readily exchanged with a new one, so that the time during which the barge is required to be stopped for changing the packing can be shortened.

In recent years, environmental hazards have been an important social problem, and therefore the sand or the like must be absolutely prevented from leaking out promiscuously from the barge during navigation. At the same time, it is quite necessary for the purpose of saving costs that a great deal of sand or the like be conveyed at one time in a shallow ocean. Accordingly, although the carrying barge is required to be shallow, wide and long, such a carrying barge is easily rolled or pitched, and therefore an effective packing arrangement which resists the effects accompanying rolling or pitching is required. The packing arrangement of the present invention surely meets the aforementioned requirements.

Although the present invention has been fully described in connection with the preferred embodiments thereof with reference to the accompanying drawings, it is to be noted that various changes and modifications will become apparent to those skilled in the art. Such changes and modifications are to be understood as included within the scope of the present invention as defined by the appended claims unless they depart therefrom.

What is claimed is:

1. In a carrying barge having a hull including rotatable port and starboard side hull ports contacting one another while in a closed position at a center line extending along the bottom of the barge, fixed hull parts to which said rotatable port and starboard side hull parts are rotatably supported, and rotating means for rotating said port and starboard side hull parts relative to said fixed hull parts from said closed position to separate said port and starboard side hull parts along said center line and for returning said port and statboard side hull parts to said closed position, coupling means operatively connected to said rotatable port and starboard side hull parts at an opening portion of the barge defined adjacent said center line for locking said rotatable port and starboard side hull parts together in said closed position and for releasing said port and starboard side hull parts from one another at the opening portion to allow said rotating means to separate said rotatable port and starboard side hull parts along said center line, said coupling means comprising:

a T-shaped metal fitting fixed to one of said rotatable hull parts and disposed at said opening portion;

a pair of clamp arms rotatably supported on the other of said rotatable hull parts and disposed at said opening portion on opposite sides of said T-shaped metal fitting, respectively, each of said clamp arms defining an engaging portion and an engaging surface spaced from the engaging portion;

hydraulic cylinder means operatively connected to said clamp arms for rotating said clamp arms between a clamped position at which the engaging portions of said clamp arms clamp onto said T-shaped metal fitting at opposite sides thereof and a released position at which said clamp arms are effectively released from said T-shaped metal fitting; and a hydraulic clamp cylinder having a movable locking portion integral therewith, said locking portion movable to a locking position between said clamp arms at which said locking portion engages the engaging surfaces of said clamp arms and prevents said clamp arms from rotating from said clamped position, and said locking portion withdrawable from between said clamp arms to a position at which said hydraulic cylinder means is able to move said clamp arms to said released position.

2. In a carrying barge having movable port and starboard side hull parts separable from one another at the bottom of the barge from a closed position, an opening portion of the barge at which said hull parts are separable from one another, said opening portion comprising:

upper and lower opposed surfaces respectively associated with said movable hull parts and inclined at predetermined angles of inclination with respect to the bottom of the barge; and a rubber packing arrangement effecting a seal between said opposed surfaces when the hull parts are in the closed position, said arrangement including a plate-like rubber member disposed on the upper one of said opposed surfaces at an upper part thereof and extending toward the lower one of said opposed surfaces, a hollow rubber member disposed on the upper one of said opposed surfaces below said plate-like rubber member for receiving fluid therein to expand toward the lower one of said opposed surfaces, and a tubular rubber member disposed on the upper one of said opposed surfaces below said hollow rubber member.

3. In a carrying barge having a hull including movable port and starboard side hull parts contacting one another while in a closed position at a center line extending along the bottom of the barge, fixed hull parts to which said movable port and starboard side hull parts are movably supported, and separating means for moving said port and starboard side hull parts relative to said fixed hull parts from said closed position to separate said port and starboard side hull parts from said center line and for returning said port and starboard side hull parts to said closed position, coupling means operatively connected to said movable port and starboard side hull parts at an opening portion of the barge defined adjacent said center line for locking said movable port and starboard side hull parts together in said closed position and for releasing said port and starboard side hull parts from one another at the opening portion to allow said separating means to separate said port and starboard side hull parts from one another along said center line, said coupling means comprising:

a locking fitting immovably fixed to one of said movable hull parts and disposed at said opening portion;

clamp arm means movably supported on the other of said movable hull parts and disposed at said opening portion across from said locking fitting, said clamp arm means defining an engaging portion and an engaging surface spaced from said engaging portion;

hydraulic cylinder means operatively connected to said clamp arm means for moving said clamp arm means between a clamped position at which the engaging portion positively engages said locking fitting in a manner which prevents said movable hull parts from separating from one another and a released position at which said clamp arm means is effectively released from said locking fitting; and a hydraulic clamp cylinder having a movable locking portion integral therewith, said locking portion movable to a locking position at which said locking portion engages the engaging surface of said clamp arm means and prevents said clamp arm means from moving from said clamped position, and said locking portion movable to a position out of engagement with said clamp arm means at which said hydraulic cylinder means is able to move said clamp arm means to said released position.

4. Coupling means in carrying barge as claimed in claim 3, wherein said locking fitting is T-shaped, said clamp means comprises a pair of clamp arms rotatably supported on the other of said rotatable hull parts and disposed at said opening portion on opposite sides of said T-shaped fitting, respectively, each of said clamp arms defining a said engaging portion and a said engaging surface, and wherein said hydraulic cylinder means rotates said clamp arms to said clamped and released positions, said clamp arms clamping onto said T-shaped fitting at opposite sides thereof when in said clamped position.

5. Coupling means in a carrying barge as claimed in claim 3, wherein said locking fitting has a U-shaped portion defined by a pair of legs and a lock portion extending from an end of one of said legs inwardly of the U-shaped portion, said clamp arm means comprises a clamp arm rotatably supported on said other of said movable hull parts and having a first end at which said engaging portion is defined and a second end at which said engaging surface is defined, and said hydraulic cylinder means rotates said clamp arm to said clamped and released positions.

* * * * *